United States Patent [19]

Kelley

[11] Patent Number: 4,480,946

[45] Date of Patent: Nov. 6, 1984

[54] GOB CANOPY FOR A MINE ROOF SUPPORT

[76] Inventor: Jay H. Kelley, 300 Maple Dr., Greensburg, Pa. 15601

[21] Appl. No.: 312,250

[22] Filed: Oct. 19, 1981

[51] Int. Cl.[3] ..... E21D 15/14; E21D 15/52; E21D 17/02

[52] U.S. Cl. ..... 405/293; 405/297; 405/295; 299/33

[58] Field of Search ..... 405/291, 293, 295, 296, 405/297; 299/31, 33

[56] References Cited

U.S. PATENT DOCUMENTS

| | | | |
|---|---|---|---|
| 3,240,021 | 3/1966 | Meriaux et al. | 405/294 |
| 3,570,255 | 3/1971 | Shuttleworth | 405/293 |
| 3,872,678 | 3/1975 | Shuttleworth | 405/293 |
| 4,065,929 | 1/1978 | Simpson | 405/293 X |

FOREIGN PATENT DOCUMENTS

| | | | |
|---|---|---|---|
| 1918049 | 10/1970 | Fed. Rep. of Germany | 405/291 |
| 1270115 | 4/1972 | United Kingdom | 405/293 |

*Primary Examiner*—Cornelius J. Husar
*Assistant Examiner*—Nancy J. Stodola
*Attorney, Agent, or Firm*—Clifford A. Poff; Thomas H. Murray

[57] ABSTRACT

A support for the roof in longwall mining operations includes a gob canopy at the rear of a roof canopy. The gob canopy can move about a vertical pivot and a horizontal pivot by operation of a hydraulic actuator. To stabilize the support, the gob canopy moves into or out of contact with the roof at the rear of the roof canopy. The actuators can move the gob canopy to the left or right side of the roof canopy about a vertical pivot so that a skeg member on the upper surface of the gob canopy drags along the mine roof for steering the roof support when it is advanced toward the mine face. Gaps between the gob canopies of side-by-side roof supports function in the manner of grizzly bars to permit recovery of small pieces of gob roof rock.

10 Claims, 5 Drawing Figures

GOB CANOPY FOR A MINE ROOF SUPPORT

BACKGROUND OF THE INVENTION

This invention relates to a gob canopy attached to the rear of a mine roof support for stabilizing and/or steering the roof support during roof-supporting operations and/or advancing movement for a longwall or shortwall mining operation.

In a longwall mining operation, a plurality of mine roof supports is arranged in a side-by-side relation and connected by double-acting piston and cylinder assemblies to a conveyor extending in front of the roof supports along the coal face being worked. The conveyor is advanced toward the receding mine face by actuating the double-acting piston and cylinder assemblies while the supports are set against the mine roof. After the conveyor is advanced, the roof supports are advanced in succession by first releasing one or more of the supports from engagement with the mine roof and then actuating the piston and cylinder assemblies to pull the mine roof support toward the conveyor. The hydraulic props of the supports are then extended until the canopy is again set against the mine roof.

Generally, a face-cutting machine travels from end-to-end along the mine face while guided and usually supported by the conveyor. The cut material is loaded on the conveyor and transported to the main entry at one end of the mine face. Two types of longwall mining operations may be carried out, namely an advancing mine face and a receding mine face. In both mining operations, the coal face extends at right angles between the entries. Coal is transferred in the main entry from a conveyor extending along the mine face to other coal-conveying equipment used to transport the coal for delivery from the mine. In these types of longwall mining operations, several roof supports with relatively long roof canopies must be advanced along the entries in conjunction with a multitude of other roof supports arranged in side-by-side relation along the path of travel by the mining machine.

The roof supports at the entries have much longer canopies to provide support for the entry roof at the side of the longwall face from a position which is generally aligned with the roof supports arranged along the mine face. T-shaped roof areas are formed by the junction of the entry roof and the roof at the longwall mine face. The entry roof is cumbersome to support because of the congestion by equipment. Also, roof supports in the entries usually have self-contained advancing mechanisms, e.g., walking beams, since there is a lack of anchors necessary for use with the same type of advancing cylinders used to move roof supports toward the mine face. The roof supports in the entries usually have canopies that extend forwardly beyond the longwall mine face into the gallery at the sides thereof. Because of the cantilevered nature of the canopy for these roof supports, the forward toe portions of the bases which rest on the floor are subjected to very high localized loading due to the force couple on the overhung or cantilevered portion of the canopy. The same type of loading also occurs with the roof supports along the mine face but smaller in magnitude. The forward toe portion of a support base is punched or sunk into the floor when the forward force couple exceeds the limit of the load-bearing capacity of the mine floor. It is disruptive and difficult to move any roof support when the toe portion is punched into the floor. Thus, even though bearing tests may be taken of a floor to determine its capacity for bearing a support, the results must show an excessively large capacity due to the greater load imposed on the floor by the forward toe portion as compared with the rear toe portion of the base of the roof support. All of the roof supports, particularly the roof supports moving along the gallery undergo lateral shifting when they are advanced, particularly when passing over an unusually rough floor area. Advancing cylinders connected to conveyor pans are used to move the roof supports along the mine face and deliver a directed pull force that frequently minimizes unwanted lateral shifting of the roof supports. Such shifting occurs to a far greater extent with supports in the gallery because the advancing mechanisms do not supply such a directed pull force.

SUMMARY OF THE INVENTION

In one aspect of the present invention, a rear canopy for a mine roof support is constructed and arranged to vary a force couple applied to the rear portion of the roof support and effectively varies a forward-to-rear loading by the base on the mine floor. In addition to a rear stabilizing function, the canopy at the rear of the roof support may be used for steering of the roof support during advancing movement toward the receding mine face.

In yet another aspect of the present invention, the roof canopy at the rear of the roof support is supported for positioning to form a grizzly screen to allow small pieces of roof rock to fall through gaps between the rear canopies. A slusher can be moved back and forth at the gob side of the roof supports to carry small pieces of gob roof to form the pack walls.

It is an object of the present invention to provide a gob canopy means extending in a cantilevered fashion rearwardly of a roof canopy of a mine roof support and hinged for pivotal movement by operation of an actuator for angularly adjusting the gob canopy means relative to a roof canopy of the mine roof support.

It is a further object of the present invention to provide a gob canopy means at the rear of a longwall and/or shortwall shield for stabilizing, steering and/or forming a grizzly screen.

More particularly, the present invention provides a mine roof support including the combination of a base for support by a mine floor, a roof canopy generally overlying the base with a roof canopy portion extending forward beyond the forward edge of the base, hydraulically-extendible prop means between the base and the roof canopy to support and move the roof canopy relative to the mine roof, gob canopy means extending rearward of the roof canopy in a generally planar fashion for forming a roof-bearing rearward extension to the roof canopy, hinge means for cantilevered pivotal movement of the gob canopy, and hydraulic actuator means between the gob canopy means and the base for angularly adjusting the gob canopy means relative to the roof canopy.

The gob canopy means of the present invention can be added to existing roof supports. In the preferred form of the mine roof support of the present invention, the aforementioned hinge means includes horizontal and vertical pivots for vertical and lateral pivoting of the gob canopy. To facilitate guiding of the roof support while advanced along the mine floor, the gob canopy means includes an upstanding rib projecting above the roof-contacting surface thereof. The rib forms an elongated skeg that can be angularly positioned relative to the roof support to slide along the mine roof for steering the roof support when moved along the mine floor. The gob canopy can be planar or sloped upwardly from its horizontal pivot. A 1% of slant upward is typical and preferred.

The hydraulic actuator means for the gob canopy means preferably includes a hydraulically-extendible prop to stabilize the roof support by imposing a force couple on the base in opposition to a second force couple which is imposed on the base due to forces on the roof canopy portion which extends forwardly beyond the forward edge of the base. In this way, the force couple developed by the prop of the actuator means changes the load between the forward edge of the base and the mine floor. The load change on the roof support base can bring about a lessening or increasing of the tip force between the base and the mine floor. In a further embodiment of the present invention, the foresaid hydraulic actuator means includes a hydraulically-extendible prop to move the gob canopy means about a horizontal pivot and a hydraulic piston and cylinder assembly to move the gob canopy means about a vertical pivot. The hydraulic actuator means may also take the form of two hydraulically-extendible props supported at opposite side portions of the base and converging toward each other at connection points on the central portion of the gob canopy means. The hydraulically-extendible props are operable by the delivery of hydraulic fluid at the same pressure to the props for movement of the gob canopy means about a horizontal axis. When hydraulic fluid is delivered at different pressures to the props, the gob roof canopy pivots about a vertical axis. The mine roof support of the present invention may further include a caving canopy carrying the hinge means for the gob canopy at the rear of the roof canopy. A pivot member connects the caving canopy to the roof canopy and link arms pivotally connect the caving canopy to the base. When the mine roof support includes the caving canopy, the aforementioned hinge means includes a clevis connected by a horizontal pivot to the caving canopy and a vertical pivot for connecting the clevis to the gob canopy means. Disposable or detachable members can be arranged to extend the length of the gob canopy to form rear extensions.

These features and advantages of the present invention as well as others will be more fully understood when the following description is read in light of the accompanying drawings, in which.

Figure 1:
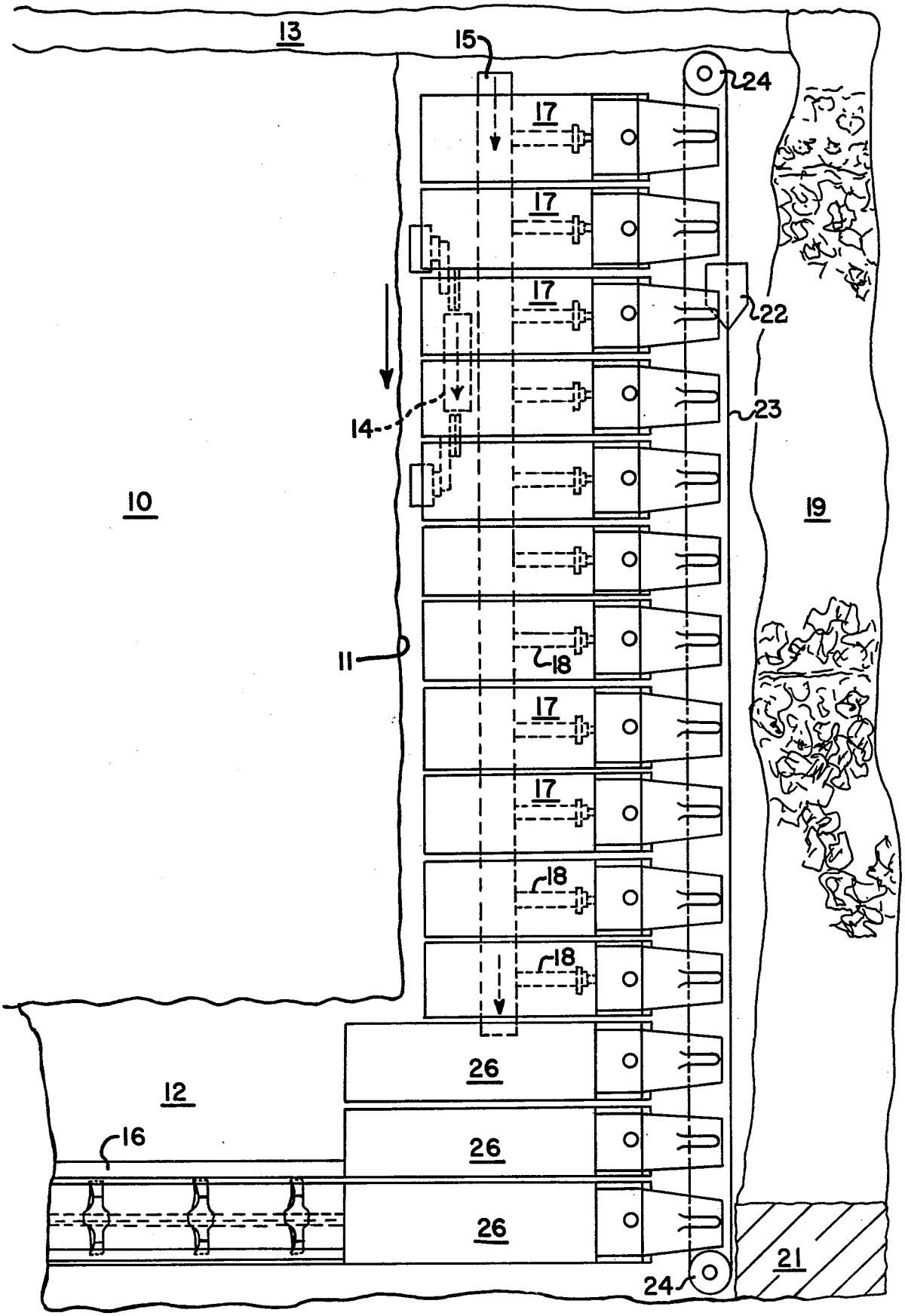
FIG. 1 is a plan view schematically showing longwall mining operations which include the use of roof supports embodying the features of the present invention.

In FIG. 1, reference numeral 10 identifies a panel of coal having a coal face 11 for a longwall mining operation. Entries 12 and 13 are cut during preparatory operations for the longwall mining operation. It is immaterial so far as the present invention is concerned whether the mining operations are carried out on the wall face by a receding or advancing longwall mining technique. A mining machine 14, such as a drum cutter, plow or the like, moves back and forth across the mine face 11 to release coal therefrom. A plow or shear is a wellknown type of cutting and loading equipment used for releasing coal from a longwall mine face. A plow cuts and loads a narrow web of coal from the mine face as it is drawn by a chain back and forth across the face. A shear is mounted on a conveyor and has one or two ranging shearing drums that are driven and pivoted to cut the desired face height. Usually the web distance or depth of cut ranges from about 20 to 36 inches. The shear not only cuts the material from the mine face but also loads the material onto the conveyor. Typically, the mining machine is connected to or part of a conveyor 15. The conveyor transports the coal to a main entry, such as entry 12, where the coal is transferred to a conveyor 16 and subsequently to other transport means which may include other conveyors for moving the coal to the ground level. After the mine wall face 11 has receded by a predetermined distance from the path of travel by the mining machine, the mining machine together with the conveyor is repositioned toward the main face for continued mining operations. The mining machine releases coal from the mine face between a floor line and roof line.

Roof supports are utilized to support the roof from a point which is adjacent but spaced from the mining machine to a point where a gob is formed by caving of the unsupported roof behind the roof supports. Individual roof supports 17 are arranged in side-by-side relation at close-spaced intervals to extend along the entire mine face. Each roof support or groups of two or more roof supports are connected by a double-acting ram 18 to the conveyor 15. The rams 18 are operated to move the conveyor and mining machine toward the mine face while the roof supports are anchored between the roof and the floor of the mine; whereas in another mode of operation, the double-acting rams are operated to advance the roof supports, usually in succession, toward the conveyor during which time the roof supports are released from engagement with the roof. The gob behind the mine roof supports is identified in FIG. 1 by reference numeral 19. The gob roof is unsupported and will usually collapse at the rear of the roof supports. A slusher is sometimes arranged to reciprocate back and forth behind the roof supports for gathering small broken pieces of roof material which is used to form a pack wall 21. The pack wall supports the roof along the entries when they extend along the sides of the gob. The slusher, as is well known in the art, takes the form of a bucket 22 connected to an endless cable 23 that is drawn back and forth between pulleys 24 between the gob and the roof supports.

Roof supports 17 are arranged for supporting the mine roof outwardly from the longwall mine face. The roof support canopy includes a forward cantilevered portion usually up to 8 feet or more in length. Additional roof supports 26 with longer roof canopies are used to support the mine roof along the entries and have a forward extended canopy portion that is cantilevered of substantially greater length as compared with roof supports 17. There is a greater need for gob canopies on the roof supports 26 used in the entries than the face shields. This is because the roof the entries should be supported beyond the coal face from a site generally aligned with the side-by-side arrangement of roof supports 17 along the longwall mine face in order to alleviate congestion at the T-section.

Figure 2:
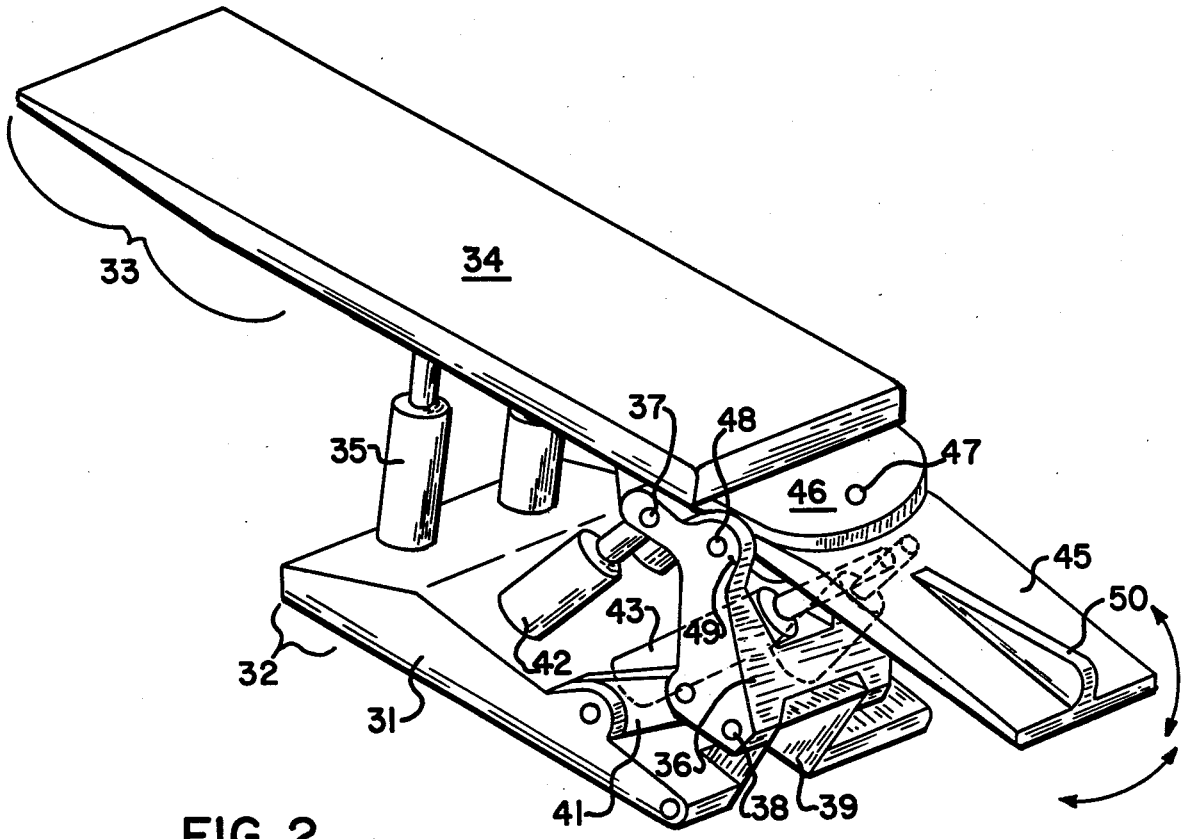
FIG. 2 is an isometric view of a roof support embodied as a shield and incorporating the features of the present invention.
Figure 3:
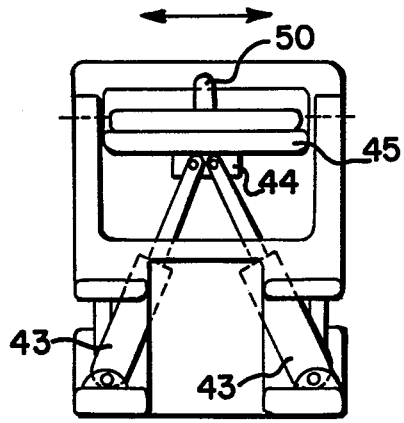
FIG. 3 is an end elevational view of the shield shown in FIG. 2.

Embodiments of a roof support are shown in FIGS. 2–5 according to the present invention. In FIGS. 2 and 3, a roof shield includes a rectangular base 31 to rest against the mine floor and slide therealong during advancing movement along the floor. A forward toe portion 32 of the base is subject to a force couple due to a cantilevered forward portion 33 of a roof canopy 34. At the forward portion of the base, hydraulically-operated props 35 extend from the base and engage the underside of the canopy 34 for displacing it into supporting engagement with the mine roof. When the props 35 are retracted, the canopy moves downward out of engagement with the mine roof. At the rear portion of the canopy 34, a caving canopy 36 is connected by a pivot 37 on an upstanding support 39 at the rear edge portion of base 31. Link arms 41 form other pivotal interconnections between the caving canopy 36 and the base at a site spaced forwardly of the pivotal support 39. A second pair of hydraulic props 42 is supported on the base and connected to the caving canopy along pivot 37. A third pair of hydraulic props 43 is supported at the opposite sides of the base from where they are angled upwardly to closely spaced-apart attachment points formed, for example, by a clevis plate 44 depending from the underside of a gob canopy 45. The gob canopy is generally planar and projects rearwardly from a support clevis 46 to which it is attached by a generally vertical pivot pin 47. The gob canopy can pivot about a vertical axis extending along pin 47 in a generally parallel direction to the mine roof. Clevis plate 46 is supported for horizontal pivotal movement by a pivot 48 which is supported at its opposite ends by anchor plates 49 on the upper surface of the gob shield. The gob canopy can pivot about a horizontal axis extending along pivot 48 toward and away from a mine roof. A skeg projects from the upper surface of the gob canopy. The skeg 50 is an upstanding plate extending along the rear central portion of the gob canopy. The canopy 45, when desired, may slope upwardly, but not downwardly, from pivot 48 preferably with an upward slope 1% of slant.

When the forces exerted by the hydraulic props 43 are the same on the gob canopy, it moves toward the mine roof about pivot 48. The force imposed by the hydraulic props through the gob canopy against the roof produces a force couple on the rear edge portion of the base 31 because the gob canopy is cantilevered at the rear edge of the roof canopy 43. This force couple acts on the rear part of the base which takes the form of a beam loaded at its opposite ends by similar force couples. The force imposed by the forward toe portion 32 on the floor can be relieved and distributed along the base by the force couple on the rear part of the base. This prevents collapse of the floor at the toe portion of the base during use of the shield to support a mine roof. When the shield is advanced, the pressure imposed by the hydraulic props 43 is used when it is necessary or desired, to lift the front toe portion 32 above an obstruction. The presssure developed by props 35 between the base and the roof canopy must be reduced. The gob canopy 45 will move about pivot 47 toward either side of the shield by supplying fluid under a greater pressure to one of the hydraulic props 43 as compared with the other prop 43. In this way, the skeg on the gob canopy will drag along the mine roof at an angular relation to the advancing movement of the shield for steering the shield while it is advanced along the mine floor.

The gob canopy for each of a plurality of roof shields when arranged in side-by-side relation forms restricted gaps between the various gob canopies such that small pieces of fallen roof material can penetrate the gaps for collection by the slusher. Thus, the gob canopy serves in addition to stabilizing the roof support and a guiding function as discusssed above, the additional function of grizzly bars.

Figure 4:
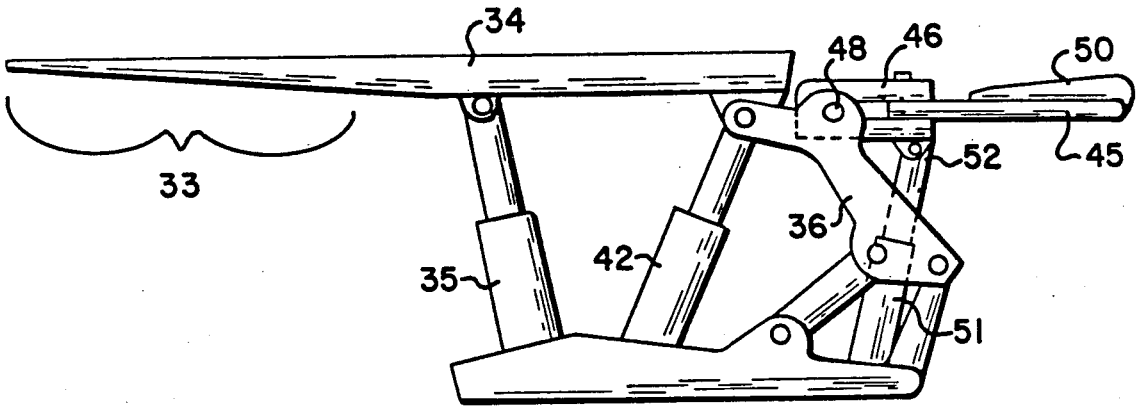
FIG. 4 is a side elevational view of another embodiment of the roof support.
Figure 5:
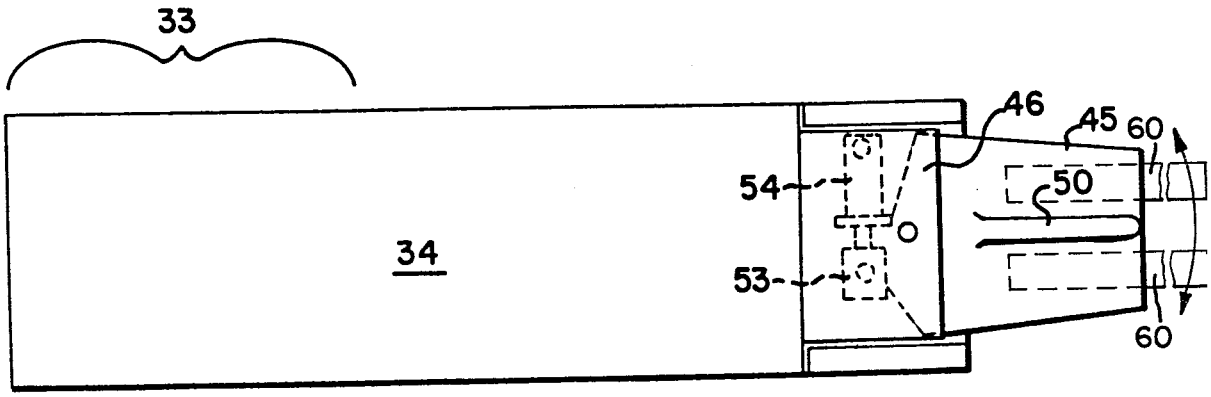
FIG. 5 is a plan view of the embodiment of the shield shown in FIG. 4.

In FIGS. 4 and 5, a further embodiment of the shield is shown which differs from that already described in regard to FIGS. 2 and 3 by the provision of a hydraulic prop 51 carried on the central rear portion of the base and coupled to a dependent clevis plate 52. Projecting forwardly from the gob canopy in the gap of the clevis 46 is a control arm 53. Arm 53 extends through an opening in the bottom of clevis 46 where it is attached to the rod end of a piston and cylinder assembly 54. The operation of the shield shown in FIGS. 4 and 5 achieves the same purposes as already described in regard to the shield shown in FIGS. 2 and 3. However, pivotal motion of the gob canopy occurs about pivot 48 by the operation of hydraulic prop 51; whereas pivotal movement of the gob canopy about pivot 47 occurs through the operation of piston and cylinder assembly 54.

In present-day mining operations, there is a trend and desire to increase the length of forward canopy roof supports. This increases the force couple on the base of the roof support to a greater undesired extent, even though from an operational point of view, the greater canopy lengths allows more space for the workers. The gob canopy of the present invention effectively provides for uniform loading of the support base by the off-setting force couple developed on the gob canopy. In another aspect of present-day mining operations it is important to allow the roof to cave over the caving shield, in the case of shield-type roof supports, so that most of the time the gob canopy will be engaging broken rock. When advancing the shield, the gob canopy will be dragging—except when elevated to raise the front toe portion. When the toe is free, the gob canopy will again be lowered until setting the shield against the roof.

In FIG. 5, there is illustrated schematically rearwardly-extending extension members 60 that are detachably connected to the gob canopy 45.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. A mine roof support including the combination of a base for support by a mine floor, a roof canopy generally overlying said base with a forward roof canopy portion extending forward beyond a forward toe portion of said base, hydraulically-extendible prop means between said base and said roof canopy to support and move said roof canopy relative to a mine roof above said mine floor, gob canopy means extending rearward of said roof canopy in a generally planar fashion for forming a roof-bearing rearward extension to said roof canopy, hinge means including horizontal and vertical pivots interconnecting said gob canopy means with a rear portion of said roof canopy which is opposite said forward roof canopy portion for cantilevered pivotal movements of said gob canopy means at a rear portion of said roof canopy, and hydraulic actuator means between said gob canopy means and said base for angularly adjusting the gob canopy means to move about said pivots toward and away from said mine roof and generally parallel thereto relative to said roof canopy.

2. The mine roof support according to claim 1 further including a skeg projecting upwardly from a roof-contacting surface of said gob canopy means.

3. The mine roof support according to claim 1 or 2 wherein said hydraulic actuator means includes a hydraulically-extendible prop arranged between said base and said roof canopy to impose a first force couple on said base in opposition to a second force couple imposed on said base due to forces on said forward roof canopy portion for changing a load between said forward toe portion of said base and the mine floor.

4. The mine roof support according to claim 1 wherein said hydraulic actuator means includes a hydraulically-extendible prop to move said gob canopy means about said horizontal pivot, and a hydraulic piston and cylinder assembly to horizontally position said gob canopy means relative to said roof canopy about said vertical pivot.

5. The mine roof support according to claim 1 wherein said hydraulic actuator means includes two hydraulically-extendible props each supported at one of opposite sides of said base for extending toward each other at connection points at a central portion of said gob canopy means, said hydraulically-extendible props being operable to apply unequal pressure to move said gob canopy means about said vertical pivot.

6. The mine roof support according to claim 1 further including a shield carrying said hinge means for said gob canopy at the rear of said roof canopy, a pivot member for connecting said shield to said roof canopy, and link arms for pivotally connecting said shield to said base.

7. The mine roof support according to claim 6 wherein said hinge means includes a clevis connected by a horizontal pivot to said shield, and a vertical pivot for connecting said clevis to said gob canopy means.

8. The mine roof support according to claim 1 wherein said gob canopy means includes detachable rear extension members.

9. The mine roof support according to claim 1 wherein said gob canopy defines an upward slope at 1% of slant.

10. The mine roof support according to claim 2 wherein said skeg comprises an upstanding plate extending along a rear central portion of said gob canopy means which is at the end thereof opposite said hinge means.

* * * * *